United States Patent [19]

Bisbee

[11] Patent Number: 4,822,276

[45] Date of Patent: Apr. 18, 1989

[54] CHILD-PROOF CIGARETTE LIGHTER

[76] Inventor: Jerry L. Bisbee, 38153 Erie Rd. #20B, Willoughby, Ohio 44094

[21] Appl. No.: 206,089

[22] Filed: Jun. 13, 1988

[51] Int. Cl.[4] ..... F23D 11/36

[52] U.S. Cl. ..... 431/153; 431/274; 431/277; 431/273

[58] Field of Search ..... 431/267, 273, 274, 277, 431/143, 153, 254

[56] References Cited

U.S. PATENT DOCUMENTS

| | | | |
|---|---|---|---|
| 3,898,031 | 8/1975 | Rusakowicz | 431/254 |
| 3,938,943 | 2/1976 | Malamoud | 431/144 |
| 4,049,370 | 9/1977 | Neyret | 431/144 |
| 4,717,335 | 1/1988 | Loveless | 431/277 |

*Primary Examiner*—Randall L. Green
*Assistant Examiner*—Denise L. Ferensic
*Attorney, Agent, or Firm*—Donald A. Bergquist

[57] ABSTRACT

This invention relates to a pyrophoric igniter, of the type commonly used in cigarette lighters. The specific improvement being a mechanically biased clutch capable of preventing the rotation of the friction wheel while the mechanical biasing clutch is engaged. The clutch may be selectively engaged or disengaged. The clutch is designed to make the lighter more safe, especially when it is viewed as a plaything by young children.

10 Claims, 3 Drawing Sheets

CHILD-PROOF CIGARETTE LIGHTER

INTRODUCTION

This invention deals with cigarette lighters wherein a fuel, either liquid or gaseous, is ignited by sparks created by an abrasive wheel or 'friction wheel' rotating against a piece of pyrophoric material commonly referred to as the 'flint'. More specifically, this invention is a pyrophoric igniter for such lighters, said igniter having a safety feature wherein the lighter is made safe in the hands of children. Since their introduction, cigarette lighters have become so commonplace as to be treated with a careless attitude by most adults and as an attractive toy by many children. In years past, it was commonplace for house fires to be described as being caused by children playing with matches. The 'match' of the present era is fluid-fueled, flint-wheel ignited, and as ubiquitous as the matches of previous years. In 1987, 200 deaths or injuries were attributed to children playing with such lighters, not to mention the property damage that is also the result of such accidental fires.

Safety regulations ban the carrying of gas-fueled lighters on commercial aircraft, probably because of the potential hazard of an unexpected large size of the flame if the lighter is used by the passenger in the reduced-pressure atmosphere of the passenger cabin; yet those in the general public totally ignore this ban because of the casual attitude they take to commonplace objects, ignoring the inherent hazards.

The invention described in this patent addresses the hazard of both liquid-fueled and gas-fueled cigarette lighters, the hazard being greatest when the lighter is in the hands of a small child. The invention prevents the igniting of the lighter by preventing the rotation of the friction wheel, thereby preventing the generating of the sparks that ignite the fuel. The invention is a spring-loaded clutch that holds the friction wheel stationary unless the clutch is held in a released position while the friction wheel is turned. The clutch may be released by the proper manipulation of the release mechanism of the invention, which manipulation, involving two simultaneous motions, the release of the clutch and the rotating of the friction wheel, is difficult for a child to perform.

DISCUSSION OF PRIOR ART

No previous patents that are directed to the subject of this invention were uncovered in a search of the following Patent Office classifications: D27/36, 431/267, 431/273, 431/274, 431/275, and 431/277.

Pre-sale security devices for disposable lighters have been patented. In these devices, a shield or obstruction to the operation of the thumb lever (and hence the fuel valve) is removed after the lighter is purchased and before the lighter can be used. Some of these devices shield or cover the friction wheel as well, making the friction wheel inoperable prior to purchase. In each case the obstruction or shield is held in place by an attachment means that is destroyed when the obstruction or shield is removed. Such devices are taught in U.S. Pat. Nos. 4,049,370 (Neyret) and 3,938,943 (Malamoud).

Other prior art, common to many lighters that have been sold over many years, is a lid or cover for the working parts of the lighter. This lid make the working parts totally inaccessible until it is removed. These covers or lids were likely introduced as a safety means and as a means to prevent soiling of clothing and the like when such lighters, generally employing liquid fuel fed to a fabric wick, were carried in the pocket. If the wick were to contact clothing, some of the liquid fuel would be readily transferred by capillary action to the clothing and sooty deposits on the wick might also be transferred.

SUMMARY OF THE INVENTION

It is an object of this invention to provide improved safety in a cigarette lighter employing pyrophoric ignition means comprising a friction wheel that abrades a pyrophoric material to produce sparks that ignite a fuel. The pyrophoric igniter of this invention is constructed to include a safety device comprising a spring-loaded, manually-releasable clutch that, in its engaged position, prevents the rotation of the friction wheel and thereby prevents the generating of sparks for igniting the fuel. Other objects of the invention will become obvious from the following discussion.

DETAILED DESCRIPTION OF THE INVENTION

This invention will best be understood by referring to the attached drawings, wherein the same part is identified throughout by the same reference number.

Figure 6:
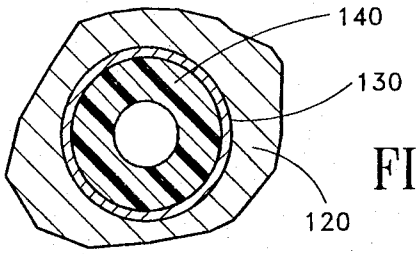
FIG. 6 is the section 6—6 of FIG. 4.
Figure 7:
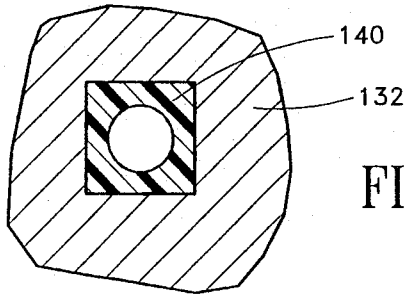
FIG. 7 is the section 7—7 of FIG. 4.
Figure 8:
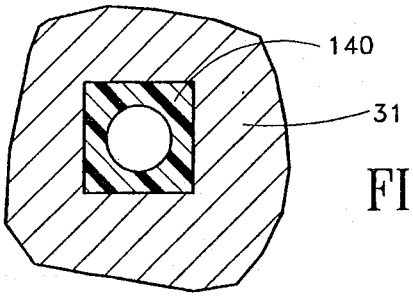
FIG. 8 is the section 8—8 of FIG. 4.
Figure 1:
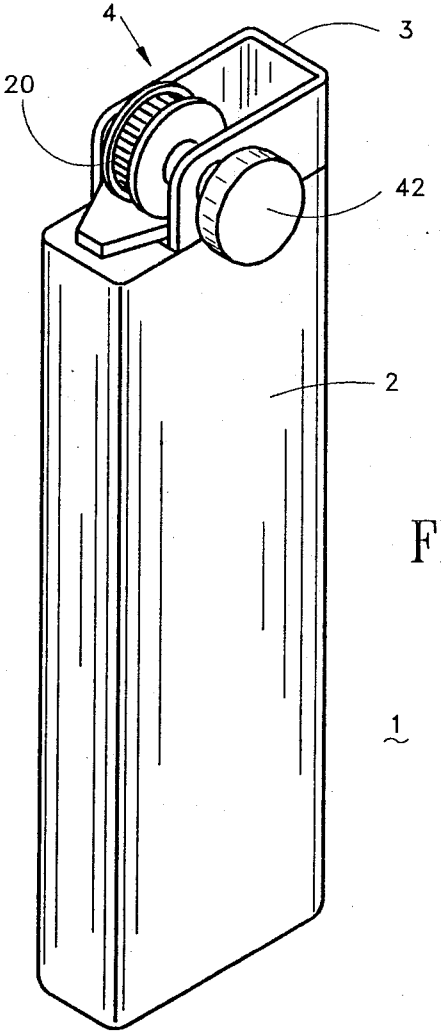
FIG. 1 presents a perspective view of a cigarette lighter having the safe pyrophoric igniter of the present invention.

FIG. 1 shows a cigarette lighter 1 of a common design but having as a part thereof a pyrophoric igniter of the present invention. The normal lighter comprises a body 2 in which is located a fuel reservoir for either gaseous or liquid fuel, a flame support generally surrounded by a windscreen 3, and pyrophoric igniter 4 comprising a pyrophoric material (a 'flint') held against a rotatable abrasive wheel or friction wheel. The improved igniter is evidenced in this drawing by the button 42 axially displaced from the friction wheel 20.

It is common for lighters to be fueled by either gaseous fuel released from a reservoir and emitted from a burner tip, or a volatile liquid fuel wetting a wick that draws it from a liquid reservoir. The type of fuel is unimportant to this invention, so details of the lighter pertaining to the fuel and the fuel burner are not shown in the drawings.

Figure 2:
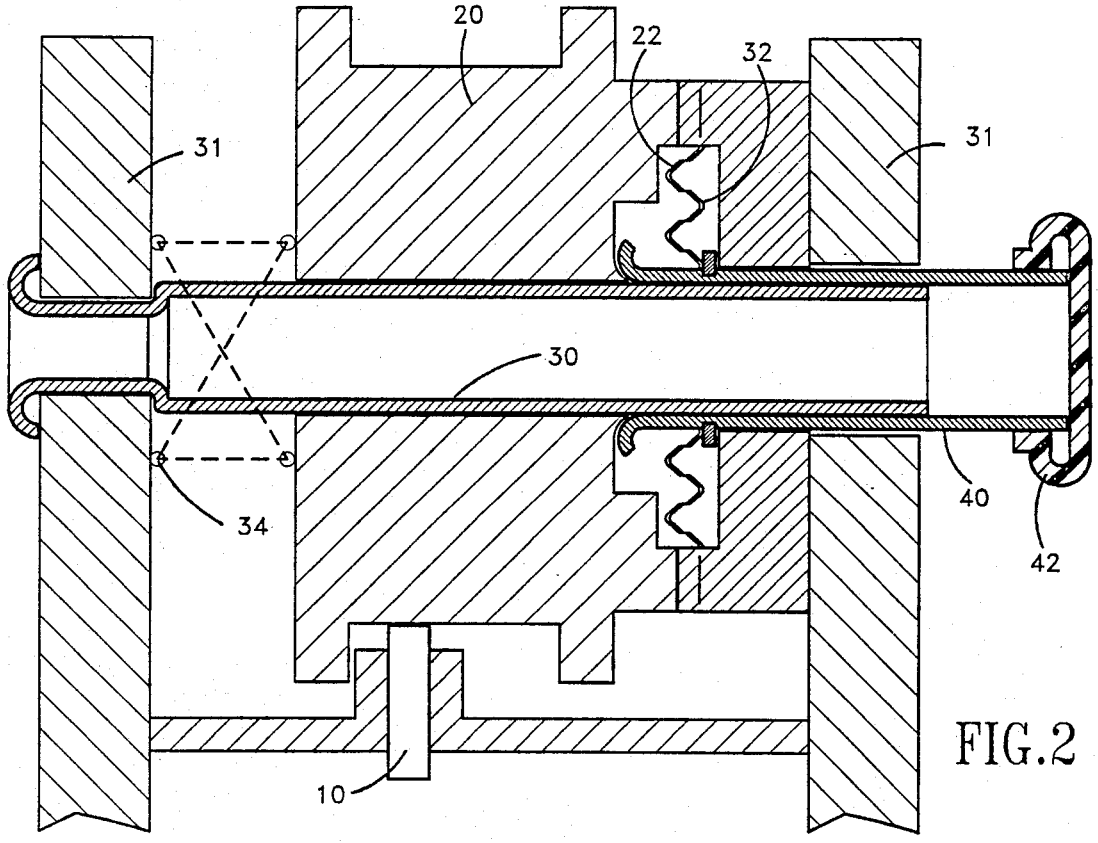
FIG. 2 is a cross-sectional view of the pyrophoric igniter assembly portion of the first embodiment of the present invention in its normal, locked condition.

FIG. 2 shows, in cross section, the igniter of this invention. Igniters of this type are commonly referred to as pyrophoric igniters because a pyrophoric material is abraded by an abrasive device. In this drawing, the pyrophoric material, commonly referred to as a 'flint' is shown at 10. The flint is in contact with an abrasive device or friction wheel 20 that may rotate about an axle 30 to generate sparks from the abrasive interaction with the flint 10 to ignite a fuel at a flame holder, not shown in the drawings. The axle 30 is supported at each end thereof by an axle support 31. Such support is often manufactured from one piece of metal that is curved around the flame holder to form a windscreen or a flame shield.

In FIG. 2, however, the friction wheel 20 is not free to rotate on its axle 30 because it includes a reticulated portion 22 that engages a mating reticulated element 32 that is not free to rotate, being fixedly attached to the axle support 31 or otherwise restricted from rotating. Furthermore, a biasing element such as a compression coil spring 34 keeps the reticulated portion of the friction wheel engaged with the mating reticulated element. In the embodiments illustrated, the reticulated elements might be considered as intermeshing crown gears or the like. The reticulated elements will hereinafter be referred to as a rotationally fixed clutch element 32 and a rotatable clutch element 22. The rotatable clutch element 22 may be made as an integral part of the friction wheel 20, as shown, or it may be a separate piece attached to the friction wheel by appropriate means to allow them to rotate as a unit.

A shaft 40 or force transmitter engages the friction wheel 20 and rotatable clutch element 22 at its proximal end and terminates with a button 42 or a cap on its distal end.

Figure 3:
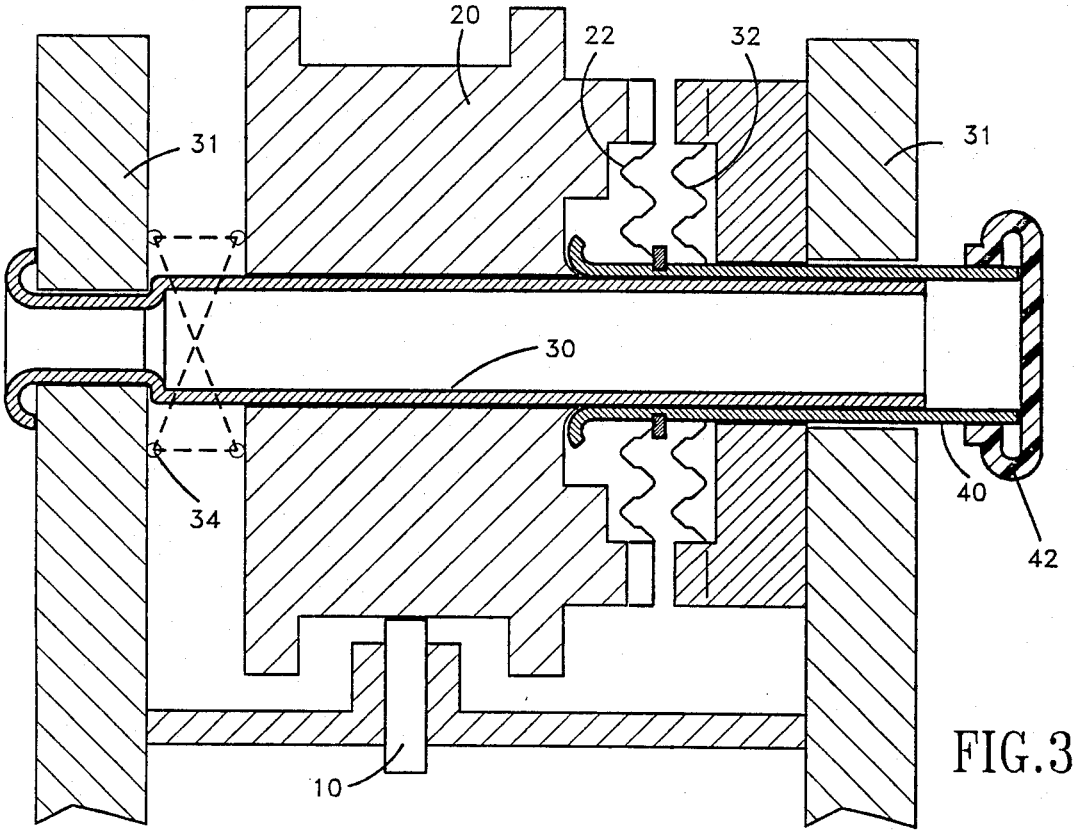
FIG. 3 is a cross-sectional view of the pyrophoric igniter assembly portion of the first embodiment of the present invention in its unlocked condition.

Pressing the button 42 with a force opposing and overcoming the biasing force of said biasing element 34 will move axially the friction wheel 20 with its associated rotatable clutch element 22, thereby disengaging the rotatable clutch element 22 from the mating rotationally fixed clutch element 32 as shown in FIG. 3. In this position, the rotatable clutch element 22 and the associated friction wheel 20 are free to rotate about their common axle 30, the friction wheel 20 abrading the flint 10 to create a spark to ignite the fuel. When the force on the button 42 is removed, the biasing element 34 returns the assembly to the locked position of FIG. 2.

It is expected that children of the age typically involved in accidental fires caused by pyrophoric lighters have not developed the mutual dexterity necessary to press the button to disengage the clutch elements, stroke the friction wheel to cause it to rotate, and, in the case of the more common gas-fueled lighters, depress the thumb lever that releases the gas to the burner tip. Thus, the present invention provides a decided safety feature over the prior art igniters for pyrophoric cigarette lighters.

It will be noted that in this first and preferred embodiment of the present invention, the force applied to the button must overcome not just the biasing force of the biasing element, but must also overcome a certain amount of friction between the flint and the friction wheel because the friction wheel is displaced axially to disengage the clutch elements.

Figure 4:
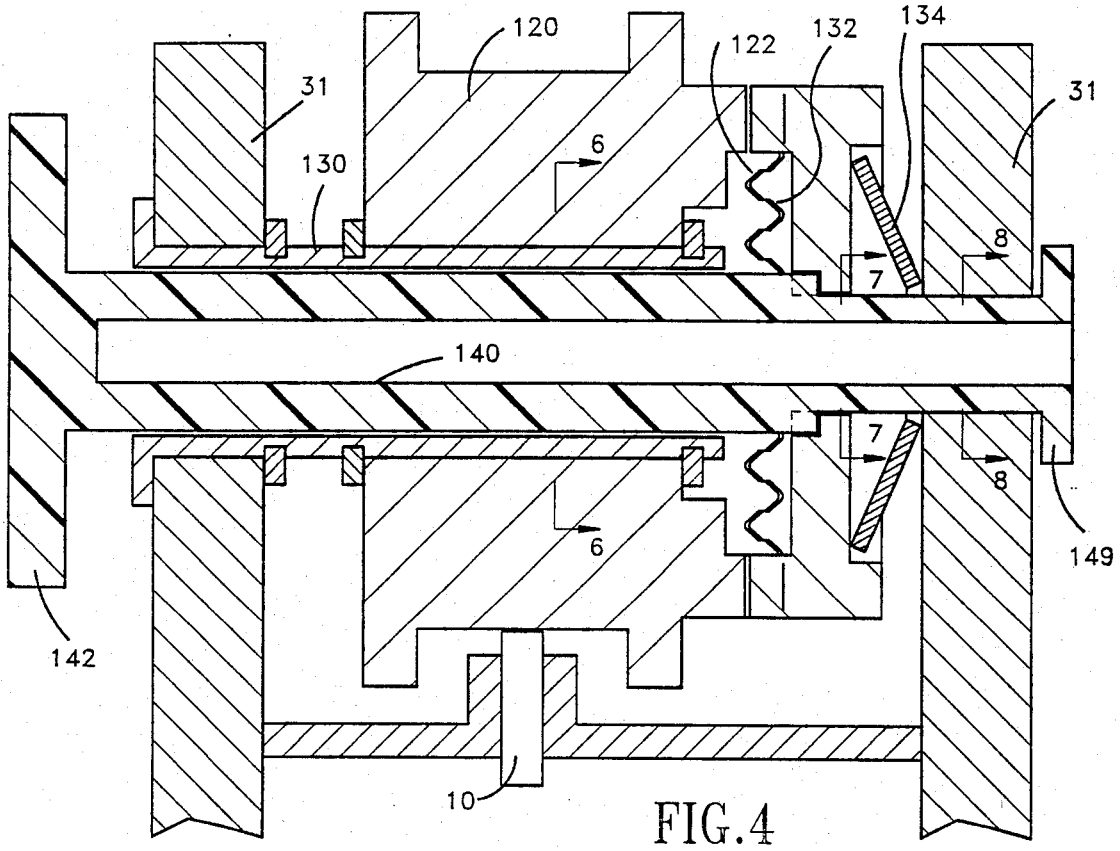
FIG. 4 is a cross-sectional view of the pyrophoric igniter assembly portion of the second embodiment of the present invention in its normal, locked condition.
Figure 5:
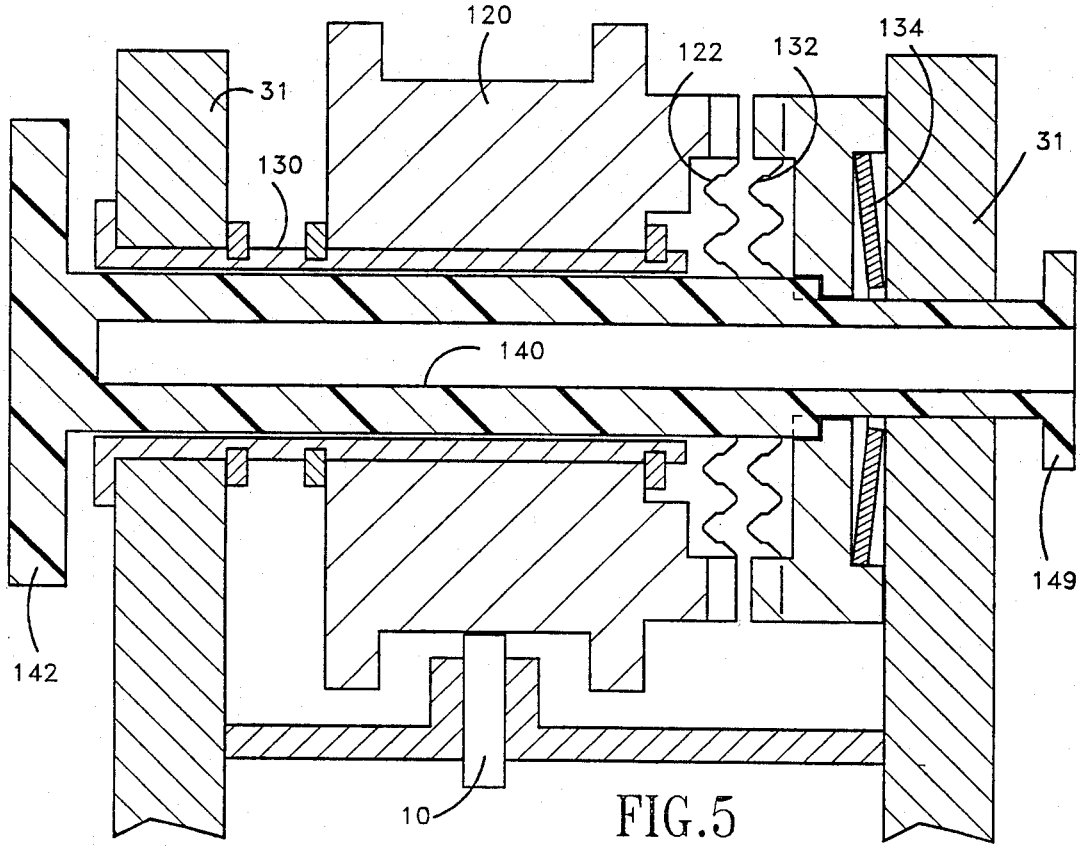
FIG. 5 is a cross-sectional view of the pyrophoric igniter assembly portion of the second embodiment of the present invention in its unlocked condition.

A second embodiment of this invention is presented in FIGS. 4 and 5. In this embodiment, the friction wheel (and its associated clutch element) does not undergo axial displacement. Rather, it is the rotationally fixed clutch element that moves axially.

In FIG. 4, the friction wheel 120 is substantially the same as in the previous embodiment, but its axle 130 is shortened and receives its support from the axle supports 31 indirectly through a central shaft 140 that, in the embodiment shown, is integral with a button 142. This shaft has a circular cross section for most of its length proximal the button 142, within the friction wheel axle 130 and up to its engagement with the rotationally fixed clutch element 132, where transition to a square cross section is made, the square cross section extending thence through a square opening in the axle support 31 and terminating with a swaged distal end 149. The portion having square cross section provides the necessary locking of the rotationally fixed clutch element 132 against rotation. The rotationally fixed clutch element 132 is urged to engagement with the rotatable clutch element 122 by a biasing means 134. In this embodiment the biasing means is shown as a Belleville washer, but a coil spring, a leaf spring, or other biasing means would be equally suitable.

Pressing the button 142 with a force opposing and overcoming the biasing force of said biasing element 134 will move axially the rotationally fixed clutch element 132, thereby disengaging it from the mating rotatable clutch element 122 as shown in FIG. 5. In this position, the rotatable clutch element 122 and the associated friction wheel 120 are free to rotate about their common axle 130, the friction wheel 120 absorbing the flint 10 to create a spark to ignite the fuel. When the force on the button 142 is removed, the biasing element 134 returns the assembly to the locked position of FIG. 4.

The form of either or both of the clutch elements may be varied from the reticulated elements shown and still lie within the spirit and scope of the present invention. One could even conceive of one element as being a rod or a pin placed transversely through the button shaft of FIG. 4, said rod or pin being of sufficient lenth to engage a reticulated rotatable clutch element at diametrically opposite points. In either embodiment shown in the drawings, the rotatable clutch element could be a single radial boss on the side of the friction wheel for suitable engagement with a reticulated rotationally fixed clutch element. Clearly, other clutch devices fall within the scope of this invention, such as a star gear as the rotatable clutch element and a spring-lever mounted pin or pawl engaging the star gear as the rotationally fixed clutch element, for one example. Thus it can be seen that this invention is broader in scope than can be detailed in a small number of examples.

Now, having presented description and specific examples of my invention by way of explanation so one skilled in this art may reproduce the product of my invention, it should be understood that the invention has greater breadth than one can delineate in a few specific examples and it is my wish and intention to include in my invention the extent of the art that may be immediately obvious from my description and examples; such breadth is included in the claims attached hereto.

I claim:

1. A pyrophoric igniter, of the type commonly used in cigarette lighters, comprising a pyrophoric material held against a friction wheel that is rotatable about an axle, which axle is supported on each end thereof by axle support means, the rotating of said friction wheel abrades said pyrophoric material, thereby generating sparks that ignite a fuel; the improvement in said igniter consists of a mechanically biased clutch means capable of preventing the rotation of said friction wheel while said mechanical biasing clutch means is engaged, said clutch means may be selectively engaged or disengaged.

2. The pyrophoric igniter of claim 1, wherein said mechanically biased clutch means comprises: a rotationally fixed clutch element, fixed with regard to rotation about said axle; a rotatable clutch element that rotates with said friction wheel about said axle; and a mechanical biasing means that holds said two clutch elements in engagement with one another; whereby the rotation of said wheel is prevented by said engaged clutch elements except when a user-applied force sufficient to overcome said mechanical biasing means is applied in a direction to move one clutch element away from engagement with the other clutch element, thereby disengaging said clutch means and allowing the rotation of said wheel for generating sparks to ignite a fuel.

3. The igniter of claim 2 wherein said rotationally fixed clutch element and said rotatable clutch element comprise mating reticulated surfaces, such elements as intermeshing crown gears or the like, for example, wherein said clutch elements share a common axis with said axle of said friction wheel, though they may be axially displaced therefrom.

4. The igniter of claim 3 wherein disengagement of said clutch elements is effected by axial movement of said rotatable clutch element away from said rotationally fixed clutch element on the same axle as is mounted said friction wheel, said friction wheel may also be axially moved, wherein such axial movement of said rotatable clutch element is caused by an axially-applied user-supplied force on a force transmitter that extends beyond one end of said axle upon which said wheel and said rotatable clutch element may rotate.

5. The igniter of claim 3 wherein disengagement of said clutch elements is effected by axial movement of said rotationally fixed clutch element away from said rotatable clutch element on the same axle as is mounted said friction wheel, wherein such axial movement of said rotationally fixed clutch element is caused by an axially-applied user-supplied force on a force transmitter that extends beyond one end of said axle upon which said wheel and said rotatable clutch element may rotate.

6. The pyrophoric igniter of claim 4 wherein said rotationally fixed clutch element comprises a reticulated surface formed from said axle support, as by a stamping process or a punching process, for examples.

7. The igniter of claim 2 wherein said mechanical biasing means comprises a coil spring.

8. The igniter of claim 2 wherein said mechanical biasing means comprises a leaf spring.

9. The igniter of claim 2 wherein said mechanical biasing means comprises a Belleville washer.

10. The igniter of claim 2 wherein said rotatable clutch element comprises a reticulated surface, such elements as a spur gear, a crown gear, or the like, for examples, and said rotationally fixed clutch element comprises a projection from said axle support means, said projection may be, for examples, a boss, a lever arm, a pivot arm, a spring arm, or the like.

* * * * *